United States Patent [19]

Spatz

[11] 4,368,746

[45] Jan. 18, 1983

[54] VALVED COSMETIC APPLICATOR

[76] Inventor: Steven D. Spatz, 201 S. Yale, Apt. 37, Hemet, Calif. 92343

[21] Appl. No.: 268,391

[22] Filed: Jun. 1, 1981

[51] Int. Cl.[3] ..... A45D 40/30

[52] U.S. Cl. ..... 132/88.5; 132/88.7

[58] Field of Search ..... 132/88.5, 88.7; 401/198–204

[56] References Cited

U.S. PATENT DOCUMENTS

| | | | |
|---|---|---|---|
| 2,549,227 | 4/1951 | Ostrander | 401/198 |
| 3,637,316 | 1/1972 | Bross | 401/198 |
| 3,998,235 | 12/1976 | Kingsford | 132/88.7 |
| 4,002,182 | 1/1977 | Michel | 132/88.7 |

FOREIGN PATENT DOCUMENTS

| | | | |
|---|---|---|---|
| 1543124 | 9/1968 | France | 401/198 |

*Primary Examiner*—G. E. McNeill

*Attorney, Agent, or Firm*—Bernard Kriegel

[57] ABSTRACT

An applicator for applying cream to a person's lips including a tube for the cream having a deformable portion adapted to be squeezed to displace a quantity of cream into an applicator tip mounted on the tube. The tip includes a valve structure cooperable with the outlet of the tube to automatically close the outlet when a closure cap is applied over the applicator, to prevent undesired oozing. A spring engages the tip to open the valve after the cap is removed from the applicator.

13 Claims, 3 Drawing Figures

VALVED COSMETIC APPLICATOR

The present invention relates to dispensers for fluent materials, and more particularly to dispensers adapted to be held in a person's hand for use in applying the fluent material to a person's lips, or other parts of the body.

In U.S. Pat. No. 3,807,881, a cosmetic applicator is disclosed containing a cream adapted to be fed to the tip portion of the applicator for application to a person's lips. To feed more cream to the tip portion, a nut member, threadedly meshing with a screw shaft, is rotated to axially move the shaft and a piston fixed thereto toward the tip portion. Feeding of additional cream to the tip requires a person to use both hands, one to prevent rotation of the screw shaft and piston and the other to effect rotation of the nut. This two hand operation is awkward, rendering it difficult to operate the mechanism and to apply the required amount of cream to the lips.

According to the invention disclosed in the pending application of Walter B. Spatz, Ser. No. 903,048, filed May 5, 1978, for Cosmetic Applicator, it is unnecessary to relatively rotate any parts, nor is it necessary to employ both hands to feed lip cream toward the applicator tip. It is only necessary to grasp a pliant, elastic forward portion of the container between the thumb and forefinger and squeeze such portion, which acts as a pump to apply pressure to cream in the applicator and force it to the tip. Release of the squeeze pressure effects automatic relieving of the internal pressure to a value below atmospheric, enabling the ambient air pressure to automatically feed a follower piston in the applicator toward the tip, the distance moved corresponding to the volume of cream previously forced to the applicator tip. The follower piston can move in a forward direction toward the tip only, such that reapplication of the squeezing force on the pump again pressurizes the cream in the applicator, resulting in its feeding to, and recoating of, the tip.

Such devices may tend to ooze undesired cream into the tip under certain circumstances which create a pressure differential. For example, an increase in temperature can result in thermal expansion of the cream within the reservoir, increasing the internal pressure to a value about ambient pressure. When the applicator is transported from, say, a relatively low elevation to a high elevation, the ambient pressure externally of the tip is reduced. Under these conditions, undesired feeding of cream to the tip may occur. Accordingly, to avoid undesired feeding of cream to the applicator tip, a valve has been employed which can be manually opened by manipulation of the applicator and then reclosed. The manipulation steps require a conscious effort on the part of the user, and the valve may be inadvertently left in an open condition, so that the oozing problem can persist.

The present invention provides such an applicator with an improved valve to prevent undesired feeding of cream to the applicator tip.

In its preferred form, the applicator valve is automatic in its operation, so that a user need not make a conscious effort to open and close the valve. The valve opens automatically when the closure cap is removed. If the reservoir is pressurized by squeezing, for example, the valve is pressure biased towards the open position. When the closure cap is reapplied, the valve is moved to the closed position.

The valve has a head integral with a support or body of the applicator tip, and the support is reciprocable on and slidably and sealingly engages the outlet portion of a dispenser for the cream, to provide a valve seal between the outlet portion and valve head, the valve head preferably being cylindrical and movable into a cylindrical seat in the outlet portion. A closure cap is movable longitudinally over the tip into engagement with the tip to shift the tip and valve head relative to the dispenser to move the valve head into the cylindrical seat. Upon removal of the cap from the dispenser and tip, a spring exerts its spring force on the tip to shift it forwardly of the dispenser and the valve head from its seat to an open condition.

The dispenser includes a deformable plastic tube portion to which finger pressure is applicable to force the fluid cream from the tube and through the open valve into the tip. Such a tube and valved tip combination does not allow undesired dispensing of cream into the tip in response to changes in temperature or ambient pressure.

This invention possesses many other advantages, and has other purposes which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense.

Referring to the drawings.

Figure 1:
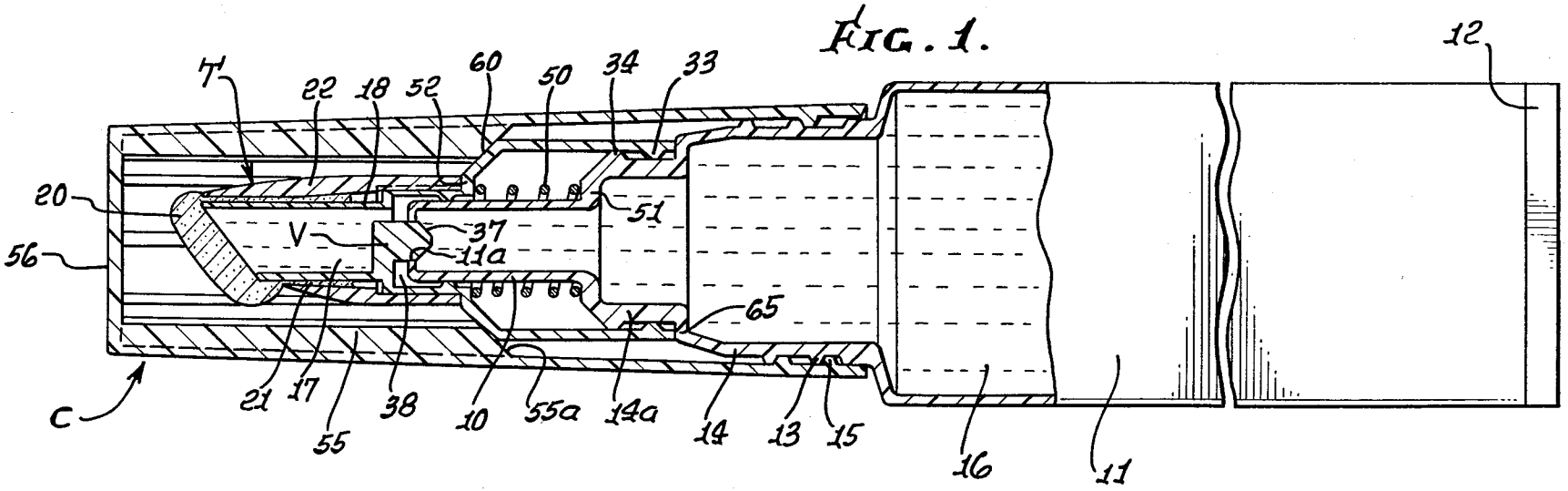
FIG. 1 is a longitudinal section through a cosmetic applicator embodying the invention.

As seen in the drawing, an applicator tip construction T extends forwardly from the outlet section 10 of a pliant dispenser tube 11. Such dispenser tubes are well known and can be inexpensively molded of plastic material, each tube being closed at its end opposite the outlet section by being crimped and sealed at 12.

The present tube structure is formed, during molding, with an external thread 13 on an enlarged cylindrical section 14 that merges into an intermediate section **14*a* adjacent to the outlet section 10. A cap C has an internal thread 15 meshing with the thread 13 on the tube to secure the cap on the tube and to cause longitudinal movement of the cap relative to the tip T, whereby, as will be later described, a valve member or head V is in closed condition with respect to the forward outlet portion 11*a* of the tube, to prevent undesired flow of the cosmetic cream or material 16 from the tube into the tip T, so long as the cap is secured in place by the meshing threads 13, 15**.

The valve head V is interposed between the cream or other material 16 in the dispenser tube 11 and a longitudinally extending passage 17 through tip T. This passage 17 is formed in an inner tip body or support 18. The outlet end 19 of the tip is beveled, and an elastic, porous pad 20, made of a suitable material, such as polyurethane or polyvinylchloride foam, extends across and bears against the beveled end. The pad includes a skirt portion 21 embracing the exterior of the body 18, the pad being secured to the tip by a retainer 22 which snugly embraces the skirt 21 and which is secured against rotation relative to the body 18 by a key 23 in the retainer, received within a companion groove 24 in an enlarged valve support section 25 integrated with the tip body 18.

The forward end 26 of the retainer is beveled to conform to the beveled end 19 of the tip, and is maintained in appropriate oriented relation to the tip by the reception of the key 23 in the groove or keyway 24. The retainer compresses the skirt portion 21 to secure the elastic, porous pad 20 in place, with the transverse inclined portion of the pad extending across the beveled end 19 of the tip. At its inner end, the retainer 22 abuts against a shoulder 27 on a tip body 28 integral with and extending rearwardly from the valve support section 25, and which has a generally cylindrical portion 30 of enlarged diameter. This body portion 30 is open at its end 31 for application to the cylindrical portion 14*a* of the outlet section 10 of the dispenser tube 11.

The tip T is retained in position on the outlet tube section 10, 14*a*, but has limited axial movement thereon. As shown, the tip section 28 has an internal rib 33 engageable with an external rib 34 on the section 14*a*. The rib 33 is spaced from the rib 34 when the valve V is in the closed condition shown in FIG. 1, the ribs being coengaged when the valve is in an open condition, shown in FIG. 2, the tip being movable axially relative to the outlet section 10.

The tip is further supported from the outlet section 10 by an internal rib 25*a* integral with the support section 25 and slidably and sealingly engaging the periphery of the outlet section, to prevent fluid leakage therebetween.

It will be understood that the components are preferably made of molded plastic material which has sufficient resilience to enable the endwise assembly of the tip body 25, 28 over the outlet end 10, 14*a* of the tube, the rib 33 in the tip body 28 expanding over the rib 34 on the tube portion 14, and then contracting for abutting engagement with the rib 34 during normal use of the applicator.

When pressure is applied to the fluent mass 16 in the container, if the valve V is open, a portion of such mass will be forced through the tip passage 17 and through the porous pad 20 to its exterior, applying a cosmetic coating thereto for application to the lips, or other portions of the person's body.

The valve means V is shown as being formed as an integral part of the inner tip body 18. An arm 40 integral with the body 18 extends part way across the passage 17, being integral with the cylindrical valve head portion 36 which merges into a tapered rearward end 37. A flow passage 38 around the head 35 and arm 40 permits fluid to flow from the tube section 10 through the cylindrical valve seat 11*a* (when the valve is open) and around the valve head 35 into the central passage 17 through the inner body 18. The forward terminus of the outlet section 10 is an inwardly directed flange 41 having the inner cylindrical valve seat 11*a* capable of snugly receiving the cylindrical periphery of the valve head when the valve is closed, to prevent the flow of cosmetic material 16 through the central opening or cylindrical seat 11*a* and into the passage 17.

Figure 2:
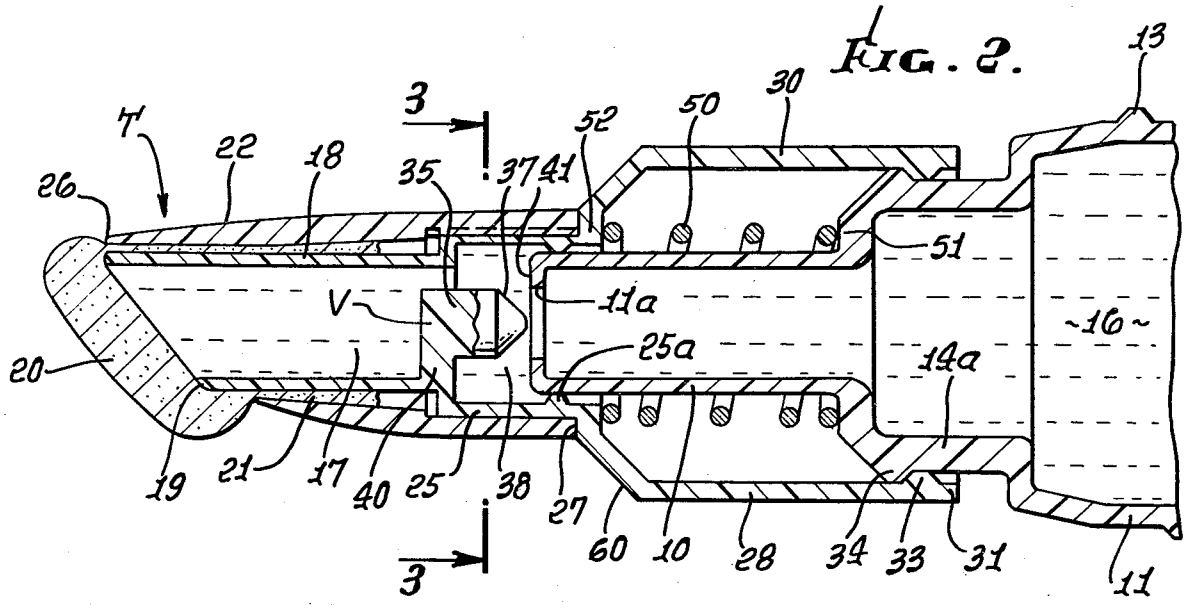
FIG. 2 is an enlarged partial section showing the cap removed and the valve in open condition.
Figure 3:
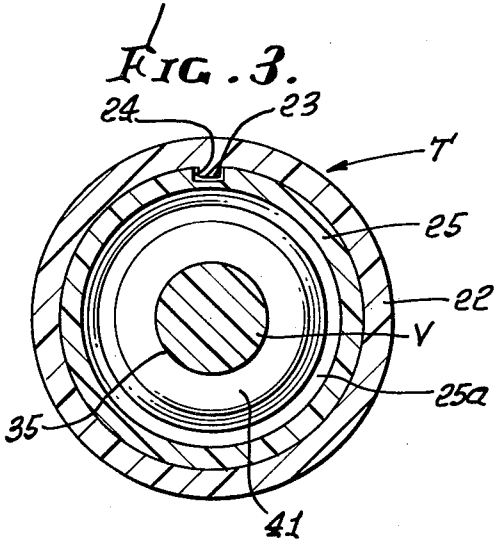
FIG. 3 is an enlarged transverse section taken on the line 3—3 of FIG. 2.

In accordance with a feature of the invention, the valve V is in a normally closed condition, as seen in FIG. 1, when the cap C is applied to the dispensing tube structure. When the cap has been removed, the tip structure 18, 25, 28 and the valve head V secured thereto are shifted forwardly of the tube 11 and of the intermediate section 14*a* and the outlet section 10 by a helical compression spring 50 surrounding the outlet section 10, with its rear end bearing against a spring seat 51 provided by the intermediate section 14*a* and its forward end bearing against a companion seat 52 formed on the tip section 28. The spring 50 expands upon removal of the cap, moving the tip portion in a forward direction and completely removing the valve head V from the cylindrical valve seat 11*a*, or to the open position disclosed in FIG. 2.

The cap C is constructed to apply an endwise, rearward force to the tip body structure T in a direction to close the valve. The cap has a plurality of circumferentially spaced ribs 55 extending rearwardly from the end wall 56 of the cap, the inner end 55*a* of the ribs being tapered and engageable with a companion taper 60 on the tip section 28. The parts are so proportioned and arranged that the cap C can be moved endwise and without rotation over the tip portions, and the internal threads 15 brought into engagement with the external threads 13 on the tube 11 before the inner tapered rib surfaces 55*a* come into contact with the companion tapered surface 60 on the body portion 28. At that time, the valve head V will still be in its open position with respect to the companion valve seat 11*a*. The cap is then rotated to fully thread the cap on the tubular container 11, the cap moving longitudinally against the tip structure T and shifting such tip structure and the valve head V as a unit in a rearward direction, to locate the valve head V within the seat 11*a*, as disclosed in FIG. 1. The extent of threading is limited by engagement of the rear end 31 of the tip member 28 against a companion shoulder 65 provided on the tube 11. The rearward feeding of the tip structure in a rearward direction further compresses the helical spring 50. Expansion of the spring and a tendency for the valve head V to move from its closed position within the cylindrical seat 11*a* is prevented by the meshing threads 13, 15.

When the dispensor is to be used, the cap C is unthreaded from the tube 11, the spring 50 expanding and shifting the tip structure T in a forward direction and the valve head V completely out of its seat 11*a* into a fully opened position, as determined by engagement of the rib 33 with the companion stop rib 34. The application of a squeezing force to the tube 11 will pressurize the cosmetic 16 or other substance within the tube and force it through the outlet opening 11*a* into the tip passage 17, the material being dispensed flowing through the porous pad 20 and coating its exterior surface.

In the event that removal of the cap from the dispensor does not result in the spring 50 shifting the valve V to its open position, the application of a squeeze on the tube 11 by a person's fingers will increase the pressure of the fluent mass within the tube 11, which will then act on the valve head V and shift such head in a forward direction completely out of the cylindrical seat 11*a*, the cosmetic material flowing into the passage 17 and through the porous pad 20 to its exterior.

I claim:

1. In an applicator for fluent material: A dispensing container for the fluent material; an applicator tip movable axially on said container and extending forwardly of said container and having a passage for fluent material dispensed from said container, said tip having a forward outlet at the end of said passage; valve means within said passage disposed inwardly of said outlet for preventing and permitting flow of fluent material from said container to said passage; a removable cap disposed over said container and tip to enclose said tip and its passage; and means responsive to application of said cap to said container for moving said tip axially of said container to close said valve means to prevent flow of fluent material from said container into said passage.

2. In an applicator for fluent material as defined in claim 1; means for opening said valve means to permit flow of fluent material to said passage upon removal of said cap from said container.

3. In an applicator for fluent material as defined in claim 1; means for opening said valve means to permit flow of fluent material to said passage upon removal of said cap from said container and tip, including a portion of said valve means exposed to the fluent material in said container and responsive to the pressure of said fluent material in said container for opening said valve means.

4. In an applicator for fluent material as defined in claim 3; said container being deformable to pressurize said fluent material therein.

5. In an applicator for fluent material as defined in claim 1; said container being a dispensing tube closed at one end and having an outlet end; said applicator tip being mounted on said outlet end.

6. In an applicator for fluent material as defined in claim 1; said container being a dispensing tube closed at one end and having an outlet portion; said applicator tip being mounted on said outlet portion; said valve means including a seat at said outlet portion of said tube and a head in said passage carried by said applicator tip and engagable with said seat to close said valve means.

7. In an applicator for fluent material as defined in claim 1; said container having a dispensing tube closed at one end and having an outlet portion; said applicator tip being mounted on said outlet portion; said valve means including a seat at said outlet portion of said tube and a head in said passage carried by said applicator tip and engagable with said seat to close said valve means; and means mounting said applicator tip on said outlet portion of said tube for relative longitudinal movement to move said head into and from engagement with said seat.

8. In an applicator for fluent material as defined in claim 1; said container being a dispensing tube having an outlet portion; said valve means including a seat at said outlet portion of said tube; and a head carried by said applicator tip; means mounting said applicator tip on said outlet portion of said tube for relative longitudinal movement to move said head into and from engagement with said seat; said means for closing said valve means including a spring engaging said applicator tip and tube to bias said applicator tip in a direction to move said head from engagement with said seat.

9. In an applicator for fluent material as defined in claim 8; said seat being cylindrical, the periphery of said seat being cylindrical and movable into said seat to provide a cylindrical sealing surface therewith.

10. In an applicator for fluent material as defined in claim 8; actuating means on said cap engaging said tip upon application of said cap to said tube to shift said head into engagement with said seat.

11. In an applicator for fluent material as defined in claim 10; said cap and said tube having a threaded connection engageable upon application of said cap to said tube before said actuating means moves said head into engagement with said seat.

12. In an applicator for fluent material as defined in claim 1; said container being a dispensing tube closed at one end and having an outlet portion; said applicator tip being mounted on said outlet portion; said valve means including a seat at said outlet portion of said tube and a head carried by said applicator tip; and means mounting said applicator tip on said outlet portion of said tube for relative longitudinal movement to move said head into and from engagement with said seat; said last-mentioned means forming a sliding seal between said tip and said outlet portion of said tube.

13. In an applicator for fluent material as defined in claim 1; and means acting between said container and tip for opening said valve means upon removal of said cap from said container and tip.

* * * * *